US005484119A

United States Patent [19]

Olive

[11] Patent Number: 5,484,119

[45] Date of Patent: Jan. 16, 1996

[54] DEVICE FOR CONTROLLING LENGTH OF PAPER PULLED FROM A WOUND ROLL THEREOF

[75] Inventor: Raymond G. Olive, Dorchester, Canada

[73] Assignee: Discount High Limited, New Brunswick, Canada

[21] Appl. No.: 218,172

[22] Filed: Mar. 28, 1994

[51] Int. Cl.[6] ..... B65H 59/02

[52] U.S. Cl. ..... 242/422.4; 242/565; 242/599; 242/613.2

[58] Field of Search ..... 242/598, 598.3, 242/598.5, 599, 599.2, 613.2, 613.3, 422.4, 565

[56] References Cited

U.S. PATENT DOCUMENTS

| | | | |
|---|---|---|---|
| 164,542 | 8/1915 | Palmer . | |
| 175,034 | 2/1917 | Graham . | |
| 877,755 | 1/1908 | Church | 242/613.3 X |
| 933,189 | 9/1909 | Linnell | 242/613.3 X |
| 1,203,588 | 11/1916 | Currie | 242/565 |
| 1,289,017 | 12/1918 | Tabrah | 242/598.3 X |
| 1,391,326 | 9/1921 | Killian | 242/599 |
| 2,540,436 | 2/1951 | Fowler . | |
| 3,850,379 | 11/1974 | Stern | 242/598.3 |
| 3,871,593 | 3/1975 | Brinton . | |

*Primary Examiner*—Daniel P. Stodola
*Assistant Examiner*—Emmanuel M. Marcelo
*Attorney, Agent, or Firm*—Jones, Tullar & Cooper

[57] ABSTRACT

An inexpensive unit for removable attachment to the spindle of a roll holder for a roll-type paper product such as toilet tissue or paper towelling. The unit is formed from a flexible plastics material and includes a center section having an arcuate bight portion and a pair of wall portions that converge from the arcuate portion and are joined together along the end edges thereof. An arm extends laterally from each end of the joined end edges of the walls. The unit is slid onto a spindle and when a roll of paper material is in turn slid onto the unit-carrying spindle the joined end edges of the walls will forcefully engage the inner surface of the roll core. When a user pulls the free end of the paper material wound on the roll the unit of this invention will rotate with the roll until the laterally extending arms engage or abut the edges of the roll holder. This signals the user that an appropriate length of material has been pulled from the roll and that that length may now be torn from the roll. If more material is required the user continues to pull on the free end of the paper material, causing the arms to flex inwardly and to be drawn through the roll holder until they emerge, flex outwardly again and are then available to once more abut the edges of the roll holder, signalling that another revolution has been completed and that the pulled length may be torn from the roll.

4 Claims, 2 Drawing Sheets

DEVICE FOR CONTROLLING LENGTH OF PAPER PULLED FROM A WOUND ROLL THEREOF

The present invention relates to the saving of paper in general, and in particular to the saving of rolled web material such as toilet tissue.

BACKGROUND OF THE INVENTION

It has long been recognized that people tend to take more than enough paper from rolls of paper towelling or toilet tissue, especially when the roll is mounted on a spindle as part of a roll holder. The tendency is to pull at the end of the free sheet and to rip the material only when the individual feels that more than enough paper has unrolled from the roll. There is little or no thought about conserving the paper, especially when the paper is provided in a commercial establishment such as a service station or a hotel. Operators of such establishments have, for the most part, considered the substantial wastage of these paper products to be an expected expense, part of the cost of doing business.

It is clear that there could be savings that would be realized at the commercial level with a device that limits the amount of paper taken from a roll thereof. There are also substantial savings to be realized at the individual level. Many people live on fixed incomes, whether through social assistance, disability pensions or old-age pensions. Toilet tissue is a commodity that everyone must purchase and when the budget is tight one has to be very careful in controlling the usage of all commodities that are not renewable. If one can control the amount of sheet material pulled from a roll each time then one can more easily control the expense associated with that commodity.

There have been many attempts in the past at providing equipment or apparatus that will restrict or limit the amount of paper that can be removed from a roll of paper at one time. These attempts have involved the design of special roll holders or accessories that can be added to existing roll holders or the spindles thereof to limit the length of sheet material pulled from the roll. For example, U.S. Pat. No. 3,871,593 teaches a stop pin that restricts rotation of the roll by engaging a stop lug on the spindle. U.S. Pat. No. 2,540,436 uses a plate attached to the spindle, the plate having raised pyramids thereon that engage the end of the roll to stop its rotation when the roll is moved laterally against the plate while that paper material is being pulled from the roll. Canadian Patent No. 164,542 has a spring-biased spindle which, when the correct amount of paper has been pulled from the roll thereon, abuts a pin. The paper is torn from the roll and the spring causes the roll to reverse to a position whereat the end of the paper can be grasped for the next pulling movement. Canadian Patent No. 175,034 uses an eccentrically mounted spindle and an eccentric pin to control the length of paper torn from a roll. When paper is pulled from the roll the spindle rotates until the pin meets a stop and the controlled length is torn from the roll. Gravity causes the roll to rotate back to a rest position, ready for the next length to be pulled from the roll. There are many other patents showing devices for limiting the length of paper pulled from a roll, such devices acting on the end of the roll core, the end of the roll itself, or the outer surface of the roll.

The devices mentioned herein require a specific roll holder or spindle or require considerable modification to the roll holder in order to be effective. The installations are expensive and the mechanisms are complex. There is little to recommend these to the average commercial establishment or to the average homeowner, particularly one who is living on a fixed, minimum income.

SUMMARY OF THE INVENTION

The present invention provides a paper saver unit that is extremely inexpensive to produce, works on most paper holders available commercially or for the home, can be installed in a matter of seconds, and provides sufficient control for an individual to limit the length of sheet material pulled from a roll each time it is used.

The present invention involves a thin flexible insert that can be slid onto the spindle of a roll holder. The insert is almost tear-drop shaped when looking at it from the end, so that when it is installed on a spindle the arcuate portion thereof will conform to the spindle while converging wall portions thereof will project away from the spindle. When a roll of paper product is then mounted on the spindle over the insert the projecting portion of the insert will bear against the inside surface of the core so that as the roll rotates on the spindle the insert will rotate with the roll.

At each end of the insert there is a narrow flexible arm that extends laterally beyond the adjacent end of the roll. The arms project a distance sufficient to engage the edges of the roll holder in which the spindle and the roll are mounted. As the roll rotates on the spindle the arms will engage the edges of the roll holder and stop the roll from rotating. At that point the individual may tear off a portion of the sheet material, the length thereof having been determined by the engagement of the projecting arms with the roll holder.

The arms are sufficiently flexible that another pull on the end of the sheet material will allow the arms to bend inwardly and permit the roll to rotate through another rotation. After the arms leave the roll holder they bend outwardly so that they can again engage the edges of the roll holder once a roll rotation of 360° has taken place. A length to sheet material corresponding to that 360° roll rotation is then available for tearing removal from the roll. If more paper is required it is possible to repeat the rotation step one or more additional times before the sheet of the desired length is torn from the roll.

The present invention is very inexpensive to produce, would be very inexpensive to purchase and is extremely easy to install. It allows the user to accept a specific length of sheet material from the roll and it allows the user to override the limitation indicated by the device if more material is needed. The device of this invention does not forcibly limit the length of material available to be torn off; it provides however a distinct signal or indication to the user to tell him that a minimum length of material is now available and that if more is needed it can be made available through another rotation of the roll. The device of this invention is so inexpensive to produce that it could even be included as a "free" gift with each package of paper product sold by environmentally and consumer conscious and caring paper producers.

In summary of the foregoing the present invention may be considered as providing a device for attachment to a spindle of a roll holder for indicating when an appropriate length of web material has been pulled from a roll of the material residing in the roll holder, comprising: a generally rectangular centre section of thin, flexible material including an arcuate bight portion and a pair of wall portions converging from the bight portion; means securing the wall portions together along the free edges thereof; and flexible arm means extending laterally from the centre section at the juncture of the wall portions.

DESCRIPTION OF THE PREFERRED EMBODIMENT

Figure 1:
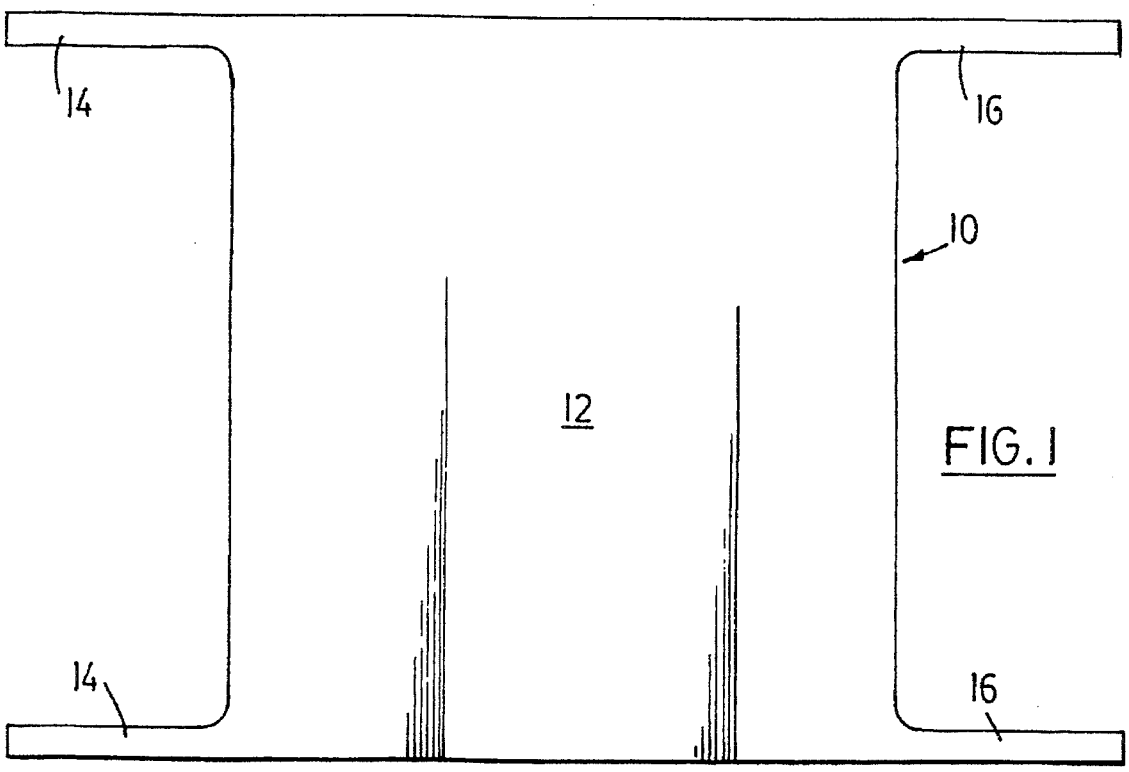
FIG. 1 is a plan view of the blank from which the present invention is made.
Figure 2:
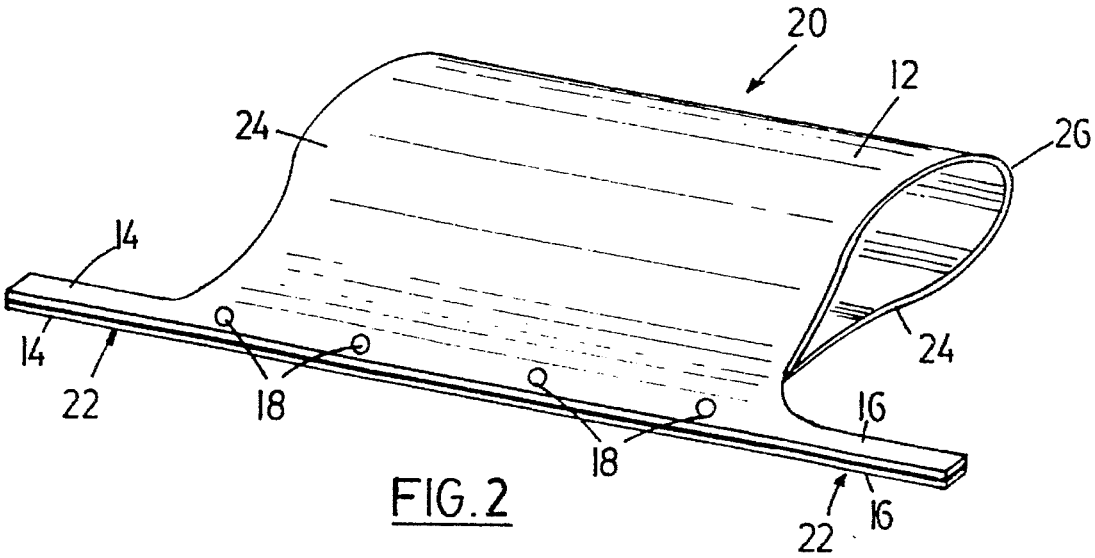
FIG. 2 is a perspective view of the paper saver unit of this invention.

FIGS. 1 and 2 illustrate the paper saver unit of the present invention. It is seen that the unit starts as a blank 10, punched or cut from a thin sheet of a plastic material such as polyethylene. There is a generally rectangular centre section 12 having a width of 10 to 11 cm and a length of about 9 cm. These dimensions should ensure that the paper saver unit will fit on a typical spindle and within the length of a typical core of a roll of toilet tissue. If the unit is to be used with other paper products, such as paper towelling it would be necessary to prepare a blank of dimensions appropriate to the product with which it is to be used. At each end of the centre section 12 there are two arms 14, 16 which extend laterally a distance of about 2 to 4 cm.

Figure 3:
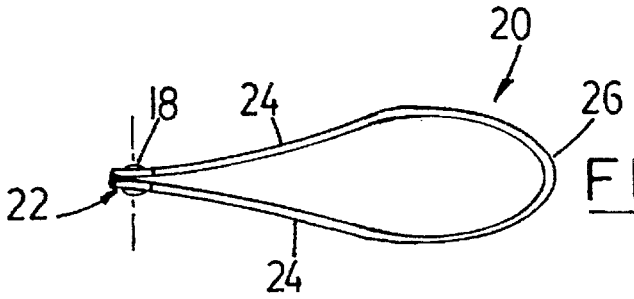
FIG. 3 is an end view of the unit of FIG. 2.

Turning to FIGS. 2 and 3 it will be seen that the blank has been formed to a generally tear-drop shape best seen in FIG. 3 with the end edges of the blank facing each other so that there is an overlap of the left and right arms 14,14 and 16,16 respectively. The end edges of the blank are secured together as by rivets 18 or, alternatively, by adhesive, heat welding, stapling or stitching. The completed unit 20 thus appears with a pair of laterally extending arms 22,22 projecting from the abutting end edges of the converging walls 24,24. The walls 24,24 are joined by the arcuate bight portion 26 at the maximum divergence thereof.

Figure 4:
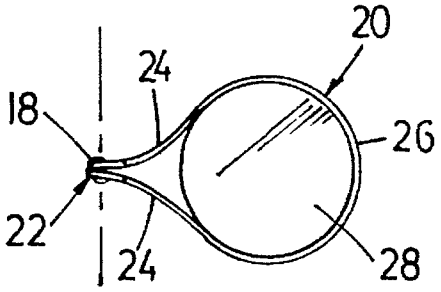
FIG. 4 is an end view of the unit assembled to a spindle of a roll holder.

Turning now to FIG. 4 the completed unit 20 is shown after a cylindrical spindle 28 of a roll holder 30 (FIG. 5) has been slid into the unit. The flexible material has permitted the spindle to be received within the unit so that the arcuate bight portion 26 has conformed generally to the arcuate surface of the spindle. The walls 24,24 converge tangentially from the expanded bight portion 26 so that the maximum dimension across the unit is greater than the diameter of the spindle and, in fact, is greater than the inner diameter of a roll core. The arms 22,22 will be spaced outwardly from the spindle and will be generally parallel thereto.

Figure 5:
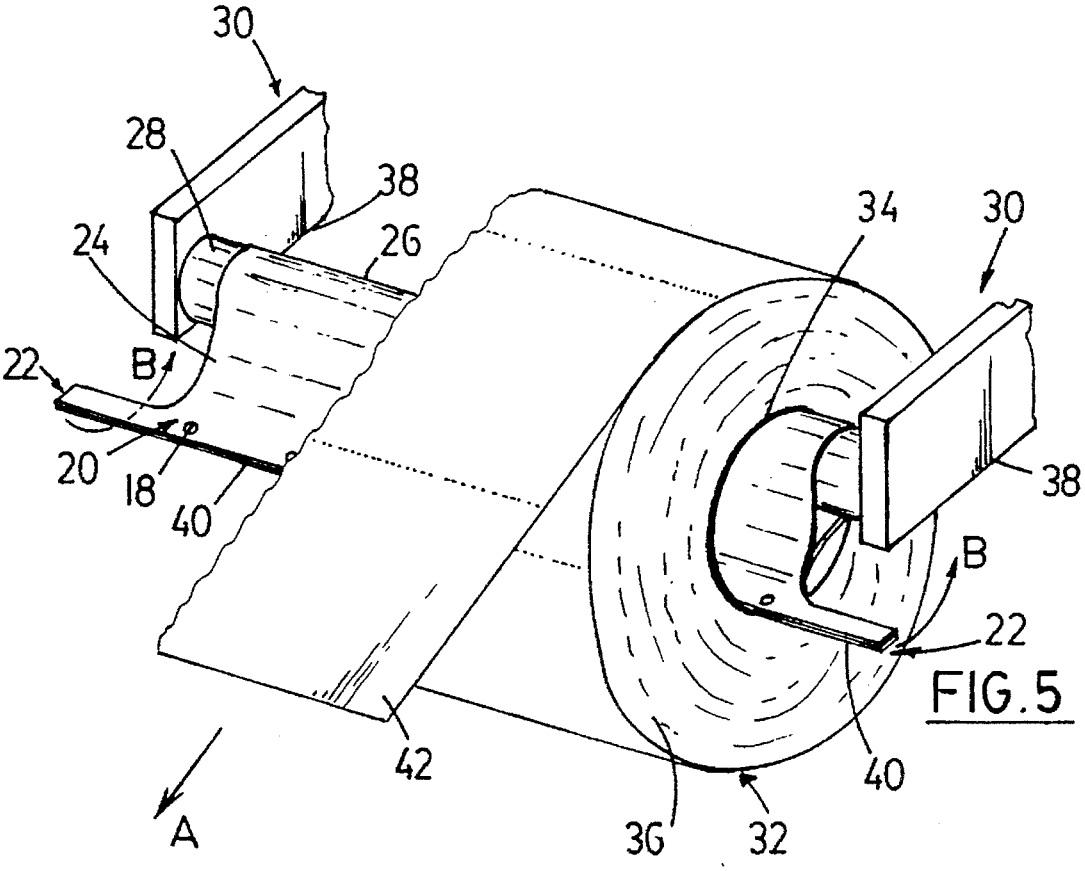
FIG. 5 is a perspective view of the unit assembled to a spindle and with a paper roll in place on the spindle and in a roll holder.

FIG. 5 shows a roll 32 of toilet tissue mounted on a spindle 28 carrying a paper saver unit 20 of the present invention. The edge 40 of the unit formed by the joining of the walls 24,24 abuts the inside surface of the core 34 with sufficient force that rotation of the roll on the spindle 28 will result in rotation of the unit 20 therewith. The arms 22,22 extend beyond the ends 36 of the roll so that as the roll rotates on the spindle the arms 22,22 will engage with the edges 38,38 of the roll holder 30. When someone grasps the free end 42 of the roll 32 and pulls the paper (arrow A) so as to rotate the roll (arrow B) the arms 22,22 will eventually abut the edges 38,38 signalling that it is now appropriate to tear the paper. If the length of paper available at this time is not sufficient for the needs of the user he can continue to pull the free end of the roll. This will cause the flexible arms to bend inwardly against the edges 38,38 of the roll holder and, with somewhat increased resistance to pulling, it is possible to obtain another revolution of the roll and a concomitant additional length of paper pulled therefrom. The arms 22,22 will bend back outwardly once they have emerged from the roll holder 30 and will once more engage or abut the edges 38,38 following the additional revolution, again giving the user the opportunity to tear the pulled length of paper from the roll.

When the roll is exhausted, the empty core is pulled from the spindle, leaving the paper saver unit of the invention behind on the spindle, ready to accept a fresh roll.

As indicated previously the paper saver unit of this invention is very inexpensive to manufacture and it would be very inexpensive for the consumer to purchase. It should not wear out with everyday use and it provides the user with a clear indication as to when an appropriate, small amount of material has been pulled from the roll. If more paper is required it is possible to continue pulling against the resistance offered by the laterally extending arms as they are pulled through the roll holder until the user receives another signal to the effect that a reasonable amount of paper has been pulled from the roll. Should the user feel that there is too much resistance as the arms 22,22 are pulled through the roll holder he could trim the ends of the arms to shorten them and thereby reduce the pulling resistance.

The present invention provides particular advantages to people living on a fixed income where it is necessary to budget very carefully and savings must be found in all aspects of one's life. The invention also is particularly helpful to individuals who are physically challenged and may have difficulty in controlling their motor functions. The abutment of the arms 22,22 against the edges 38,38 of the roll holder provides a stop for the roll and enables the user to effect a tearing action with the roll in a stopped condition. Otherwise the roll would continue to rotate freely on the spindle and extra paper would unwind from the roll after the tearing action had been completed. The next requirement for paper would likely result in an excessive amount of paper being torn from the roll.

The foregoing has described the preferred embodiment of the present invention but it is clear that modification could be made thereto without departing from the spirit of the invention. The protection to be afforded this invention is thus to be determined from the scope of the claims appended hereto.

I claim:

1. A device adapted for use with a spindle of a roll holder for indicating when an appropriate length of web material has been pulled from a roll of the material residing in the roll holder, comprising:

a centre section of thin flexible material defining an arcuate bight portion and a pair of wall portions converging from the bight portion to longitudinal end edges of the wall portions;

means securing the wall portions together along the end edges thereof; and flexible arm means extending laterally from said centre section at the secured end edges of said wall portions for initial engagement with adjacent edges of the roll holder and subsequent bending past the roll holder edges.

2. The device of claim 1 wherein said wall portions are secured together by a plurality of rivets spaced apart along said end edges.

3. The device of claim 1 wherein one of said arm means extends laterally from each of said wall portions.

4. A device adapted for use with a spindle of a roll holder for indicating when an appropriate length of wound web material has been pulled from a roll of the web material residing in the roll holder, comprising:

a centre section of thin flexible plastics material defining an arcuate bight portion and a pair of wall portions converging from the bight portion to longitudinal end edges of the wall portions;

means securing the wall portions together along the end edges thereof; and a pair of flexible overlapping arms extending laterally from said centre section at the secured end edges of said wall portions, said arms, when said spindle is received within said device and said spindle and said device are received within a core of a roll of web material mounted in the roll holder, extending beyond the ends of said roll, for engagement with adjacent edges of the roll holder during pulling action on a free end of said web material to indicate that a length of web material may be torn from the roll, said arms being sufficiently flexible to bend and pass by said roll holder edges upon further pulling of said material.

* * * * *